US006513533B2

(12) United States Patent
Spatafora et al.

(10) Patent No.: US 6,513,533 B2
(45) Date of Patent: Feb. 4, 2003

(54) METHOD FOR FORMING TUBULAR WRAPPINGS ON A CIGARETTE PACKING MACHINE

(75) Inventors: Mario Spatafora, Bologna (IT); Fabrizio Tale', Bologna (IT)

(73) Assignee: G.D Societa' Per Azioni, Pomponia (IT)

( * ) Notice: Subject to any disclaimer, the term of this patent is extended or adjusted under 35 U.S.C. 154(b) by 0 days.

(21) Appl. No.: 09/829,658

(22) Filed: Apr. 10, 2001

(65) Prior Publication Data

US 2002/0050127 A1 May 2, 2002

(30) Foreign Application Priority Data

Apr. 12, 2000 (IT) ..... BO00A 0212

(51) Int. Cl.[7] ..... A24C 1/16; B65B 11/00

(52) U.S. Cl. ..... 131/283; 131/107; 53/234; 53/461; 53/466

(58) Field of Search ..... 131/282, 283, 131/107; 53/234, 461, 466; 198/468.1, 469.1, 478.1, 485.1

(56) References Cited

U.S. PATENT DOCUMENTS

| | | | | | |
|---|---|---|---|---|---|
| 3,537,232 | A | * | 11/1970 | Mateyka et al. | 53/234 |
| 4,330,976 | A | * | 5/1982 | Blackall et al. | 493/142 |
| 4,408,439 | A | | 10/1983 | Anderson | |
| 4,823,536 | A | * | 4/1989 | Manservigi etal. | 198/476.1 |
| 5,299,679 | A | * | 4/1994 | Obara et al. | 131/282 |
| 5,373,681 | A | * | 12/1994 | Shigeta | 198/462.1 |
| 5,392,586 | A | * | 2/1995 | Imai | 53/234 |
| 5,946,890 | A | * | 9/1999 | Focke et al. | 53/228 |
| 5,996,309 | A | * | 12/1999 | Focke et al. | 53/228 |
| 5,996,318 | A | * | 12/1999 | Draghetti | 53/234 |
| 6,047,529 | A | * | 4/2000 | Draghetti | 53/234 |
| 6,125,611 | A | * | 10/2000 | Focke | 53/225 |
| 6,141,944 | A | * | 11/2000 | Spatafora | 53/234 |
| 6,219,999 | B1 | * | 4/2001 | Ghini et al. | 53/466 |
| 6,263,644 | B1 | * | 7/2001 | Ghini et al. | 53/234 |
| 6,324,817 | B1 | * | 12/2001 | Ghini et al. | 53/233 |

FOREIGN PATENT DOCUMENTS

| | | | |
|---|---|---|---|
| EP | 0776832 | * | 6/1997 |
| EP | 0 940 339 A1 | | 9/1999 |
| EP | 0 972 706 A1 | | 1/2000 |
| GB | 1134500 | * | 11/1968 |
| GB | 2235913 | * | 3/1991 |

* cited by examiner

*Primary Examiner*—Steven P. Griffin
*Assistant Examiner*—Carlos Lopez
(74) *Attorney, Agent, or Firm*—Marshall, Gerstein & Borun

(57) ABSTRACT

A method and unit for forming tubular wrappings on a cigarette packing machine, whereby groups of cigarettes are fed successively to respective conveying heads of a continuous wrapping wheel, on which an end portion of a sheet of wrapping material, folded into a U about a respective group of cigarettes and carried by a respective conveying head, is folded onto the respective group by means of a respective outer folding member moved, with respect to the wrapping wheel, so to remain substantially parallel at all times to the respective conveying head; the outer folding members being equal in number to the conveying heads.

8 Claims, 4 Drawing Sheets

METHOD FOR FORMING TUBULAR WRAPPINGS ON A CIGARETTE PACKING MACHINE

The present invention relates to a method of forming tubular wrappings on a cigarette packing machine.

More specifically, the invention relates to a method of continuously forming tubular wrappings on a cigarette packing machine, whereby groups of cigarettes are fed successively, at an input station, to a wrapping wheel rotating at constant angular speed about a respective axis.

BACKGROUND OF THE INVENTION

In known methods, the wrapping wheel comprises a number of conveying heads, each of which oscillates about a respective axis parallel to the axis of rotation of the wrapping wheel, and receives, at the input station, a respective group positioned with its longitudinal axis parallel to said axis of rotation. When received by the respective conveying head, each group is already wrapped partly in a sheet of wrapping material, normally foil, folded into a U about the group of cigarettes and having, with respect to the group, two longitudinal end tabs projecting from the rear of the respective group in the traveling direction of the respective conveying head. Each head feeds the respective group to an output station, and, between the input and output stations, causes the respective group to cooperate with an external folding device, which normally comprises a number of outer folding members, normally fewer than the conveying heads, and which are fed by a conveyor along an annular path, and each oscillate with respect to the conveyor about a respective axis parallel to the axis of rotation of the wrapping wheel. Each outer folding member provides for squarely folding one of the tabs of a respective sheet of wrapping material, while the other tab of the sheet of wrapping material is normally folded by a further folding member fitted to the respective conveying head, to obtain a tubular wrapping.

In actual use, the outer folding member follows the respective group to contact one of the tabs, normally the one furthest from the axis of rotation of the wrapping wheel, and then rotates with respect to the relative conveyor to fold the tab.

The above known methods have several drawbacks, due to each outer folding member having to oscillate in controlled manner with respect to the conveyor to fold a respective tab. This poses not only construction problems, on account of the highly complex design of the external folding device, but also functional problems, in that any jamming of the tab with respect to, and during rotation of, the outer folding member may result in the tab being folded about the wrong fold line.

Moreover, each outer folding member necessarily cooperates with a number of conveying heads on the wrapping wheel, which therefore calls for painstaking setup of the conveying heads themselves.

SUMMARY OF THE INVENTION

It is an object of the present invention to provide a method of forming tubular wrappings, designed to eliminate the aforementioned drawbacks.

According to the present invention, there is provided a method of forming tubular wrappings on a cigarette packing machine; each tubular wrapping being formed from a sheet of wrapping material folded into a U about a respective group of cigarettes and having two end portions projecting from the rear of the group and defining a first and a second tab; the method comprising the steps of feeding each group continuously, by means of a respective substantially radial conveying head, along an annular path extending about a first axis, said second tab being interposed between said first tab and said first axis; and folding the two tabs of each said sheet of wrapping material onto the respective said group, as the group is fed along said annular path, to form a tubular wrapping about the respective said group; the method being characterized in that each said first tab is folded by means of a respective outer folding member, which is associated with the respective said conveying head, is located outwards of said annular path, and is movable to cooperate with the respective said first tab at a folding station; said outer folding members being equal in number to said conveying heads located along said annular path; and each said outer folding member being moved continuously and in such a manner as to remain substantially parallel at all times to the respective said conveying head.

The invention also relates to a unit for forming tubular wrappings on a cigarette packing machine.

According to the present invention, there is provided a unit for forming tubular wrappings on a cigarette packing machine; each tubular wrapping being formed from a sheet of wrapping material folded into a U about a respective group of cigarettes and having two end portions projecting from the rear of the group and defining a first and a second tab; the unit comprising a conveying drum rotating about a first axis; first actuating means for rotating said conveying drum continuously about said first axis; a number of conveying heads, each connected to said conveying drum in a respective substantially radial position, and each for receiving a respective said group with the respective sheet of wrapping material folded into a U, and with said second tab interposed between said first tab and said first axis; first and second folding means for respectively folding said first and said second tab of each said sheet of wrapping material onto the respective said group to form a tubular wrapping about the respective said group; and the unit being characterized in that said first folding means comprise, for each said conveying head, an outer folding member located outside said conveying drum and movable to cooperate with the respective said first tab at a folding station; said outer folding members being equal in number to said conveying heads; and second actuating means being provided to move each said outer folding member in such a manner as to keep the outer folding member substantially parallel at all times to the respective said conveying head.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
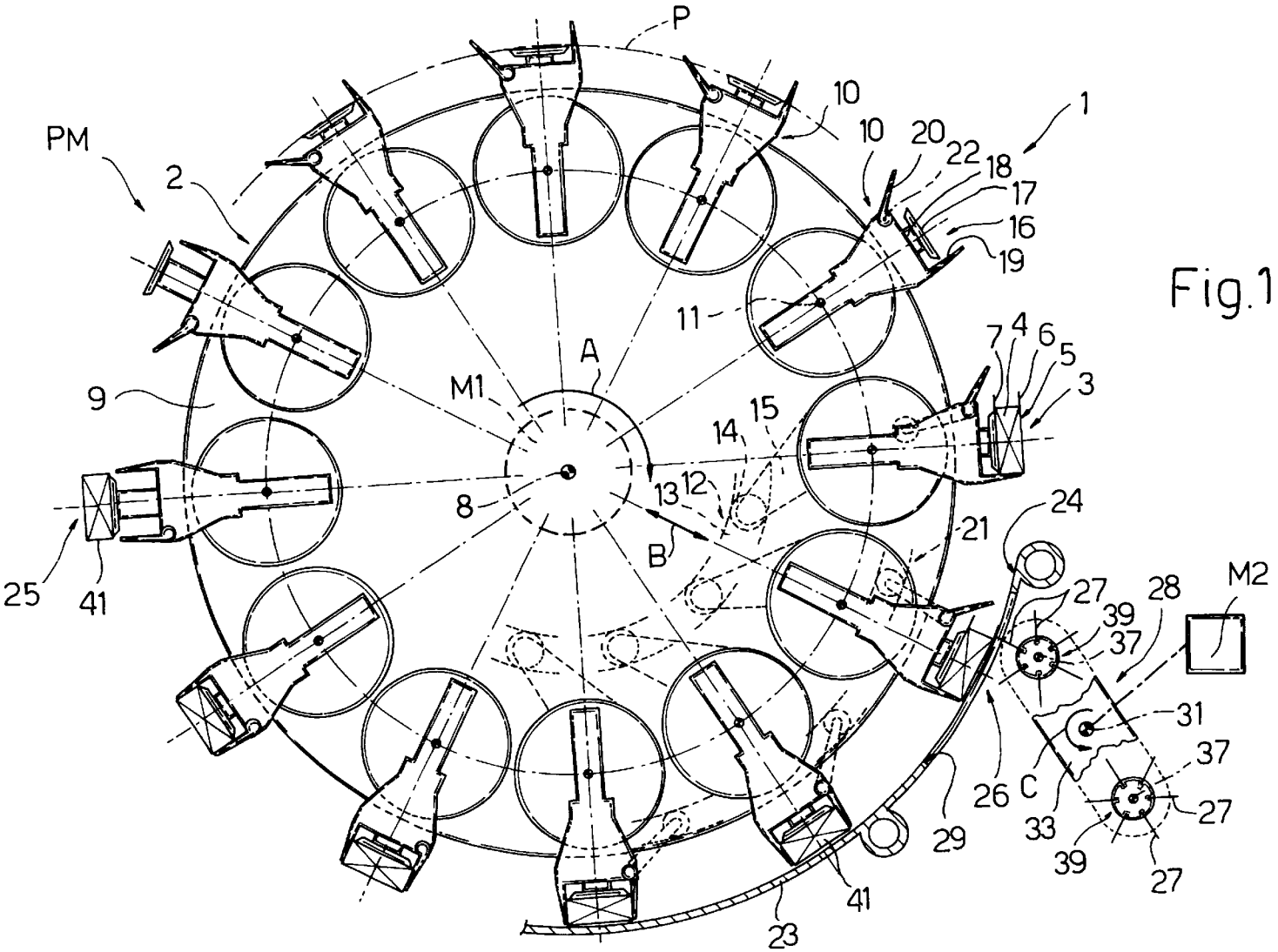
FIG. 1 shows a schematic, partly sectioned side view, with parts removed for clarity, of a preferred embodiment of the folding unit according to the present invention.
Figure 2:
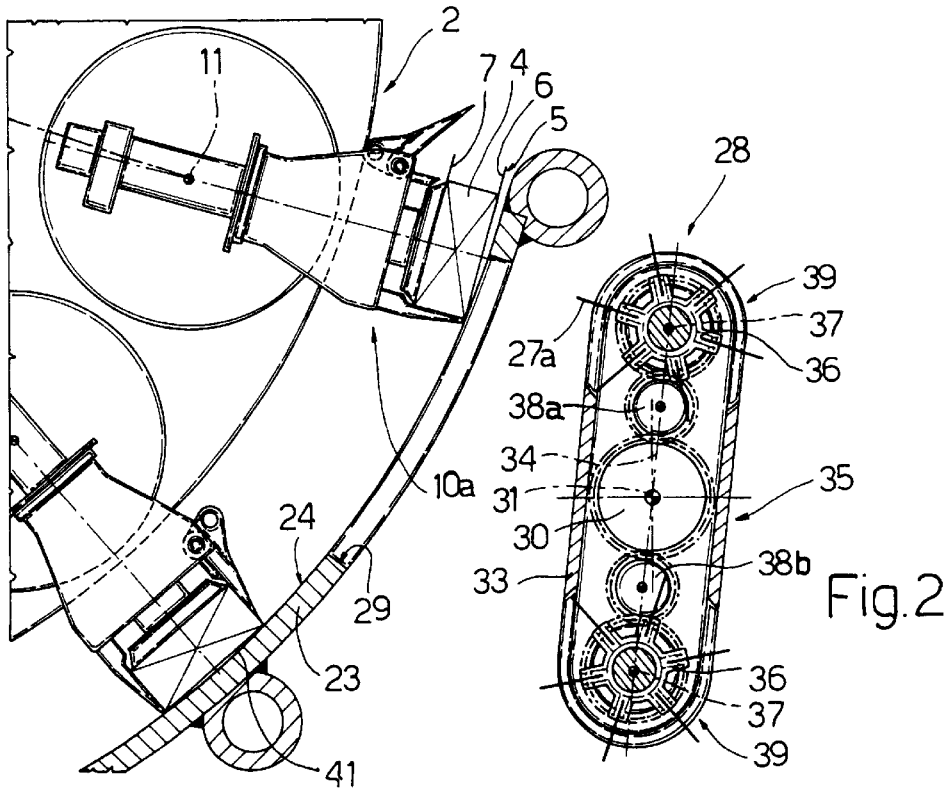
FIGS. 2, 3, 4, 5 and 6 show larger-scale details of FIG. 1 in different operating positions.
Figure 3:
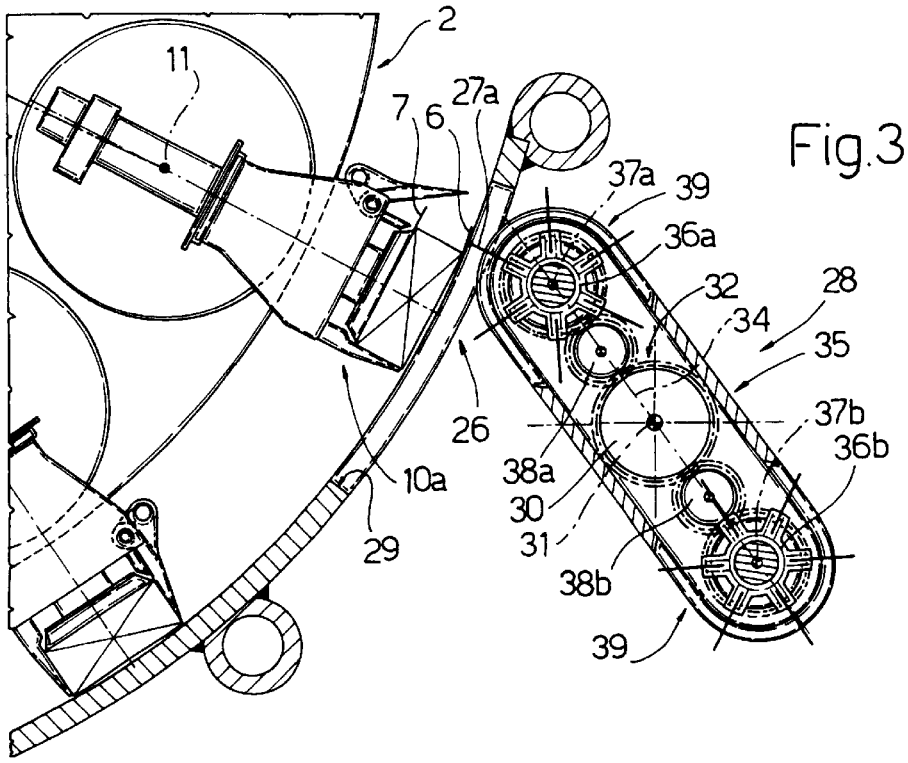
Figure 4:
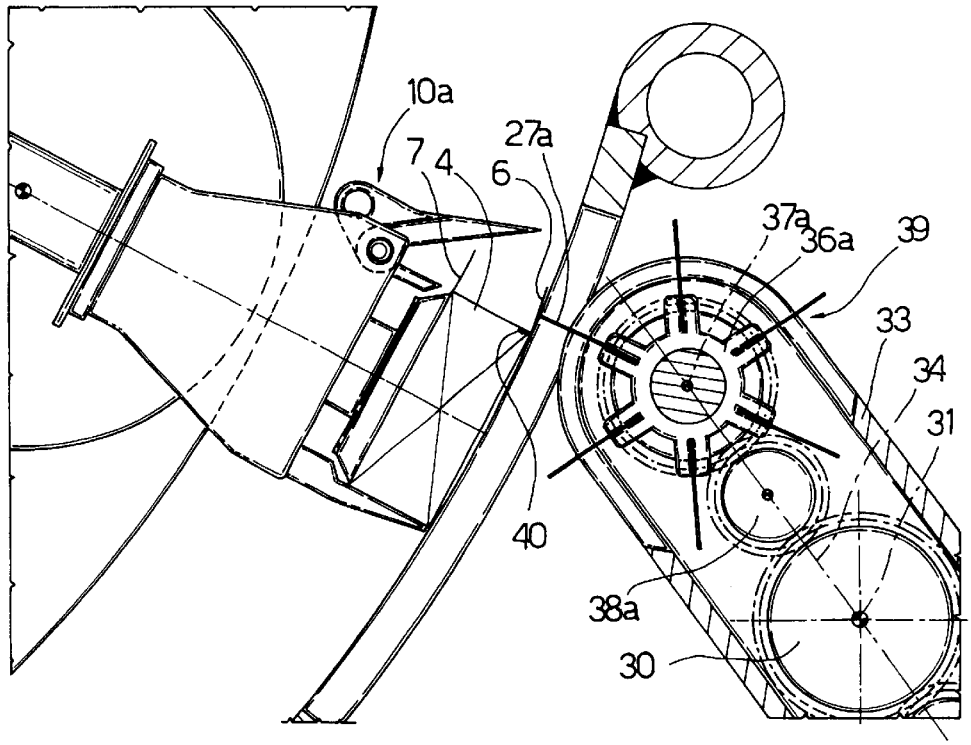
Figure 5:
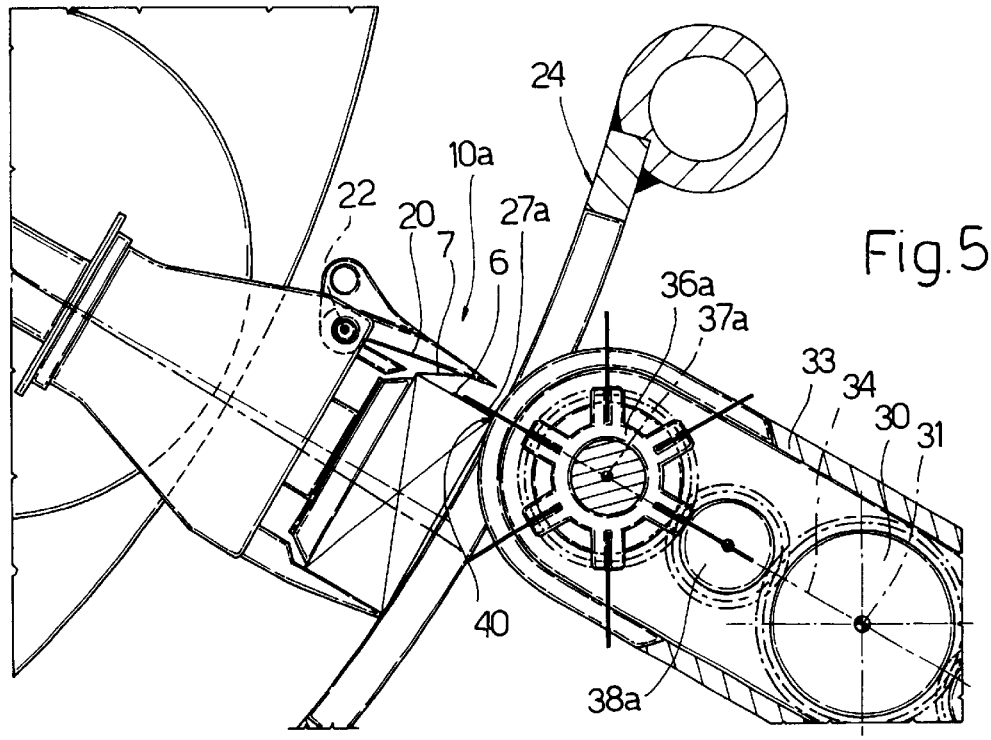
Figure 6:
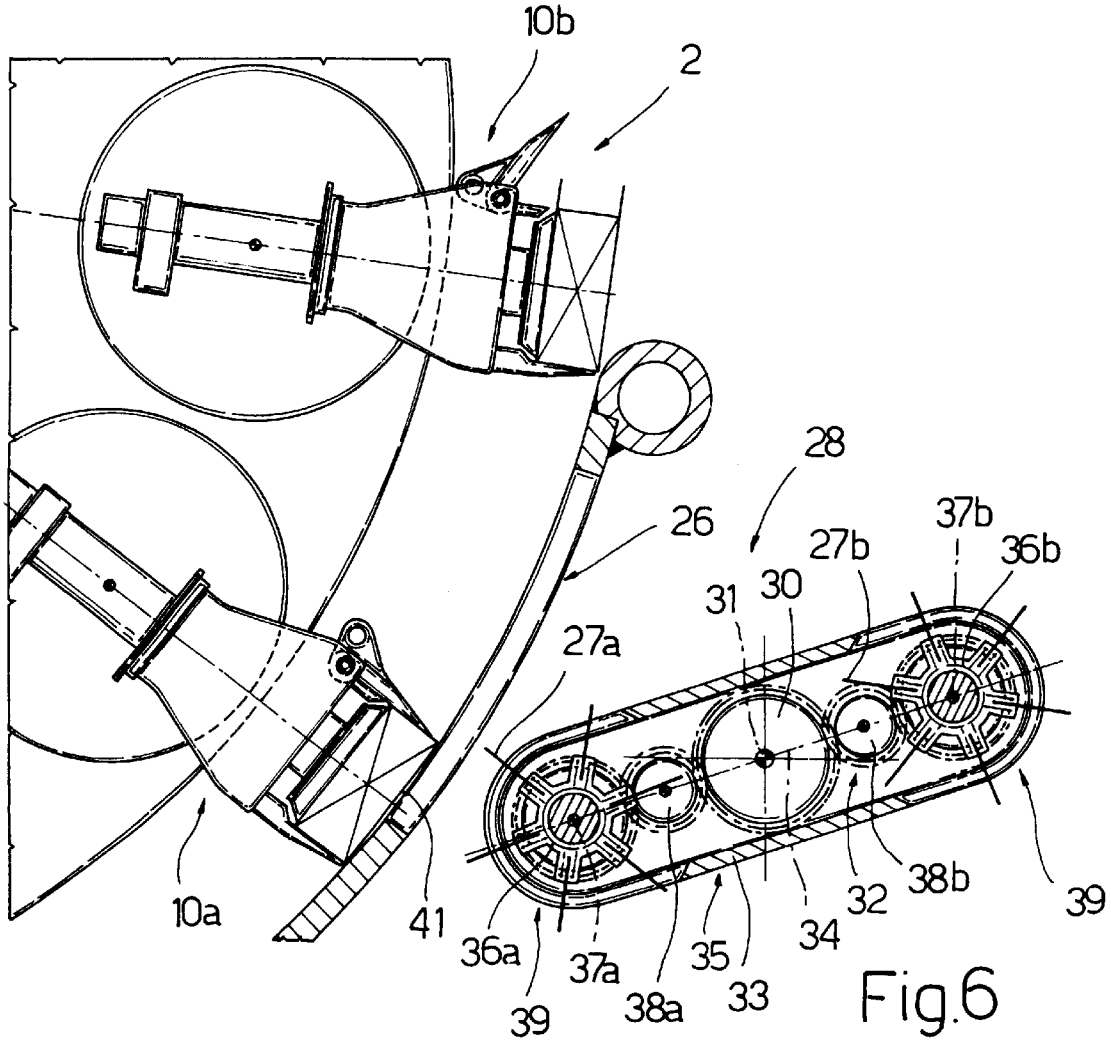

Number 1 in FIG. 1 indicates as a whole a folding unit for forming tubular wrappings on a cigarette packing machine PM shown only partly. Folding unit 1 comprises a wrapping wheel 2, which is supplied successively, at an input station 3, with substantially parallelepiped-shaped groups 4 of cigarettes, each having a respective sheet 5 of wrapping material—in the example shown, a sheet of foil—which is folded into a U about group 4 and has two longitudinal end tabs 6 and 7 projecting rearwards with respect to group 4 and to the rotation direction A of wheel 2 about a respective axis 8.

Wheel 2 comprises a drum 9 rotated by a motor M1 at constant angular speed about axis 8 in direction A; and a number of conveying heads 10, which are twelve in number in the example shown, but may be of any number n. Heads 10, which are of known type, are fitted to drum 9 in equally spaced positions about axis 8, are fed continuously along an annular path P, and are mounted to oscillate, with respect to drum 9 and about respective axes 11 parallel to axis 8, by means of an actuating device 12 comprising an annular cam 13 formed on drum 9, and a number of tappet rollers 14, each connected to a respective head 10 by the interposition of a respective lever 15 connected integrally to head 10.

At rest, each head 10 is positioned substantially radially on drum 9, and comprises a seat 16 open outwards of drum 9 in a radial direction B and for receiving a respective group 4. Each seat 16 is located outwards of the outer periphery of drum 9, and comprises a movable bottom wall 17 defined by an end wall of a radial pusher 18 associated with head 10; a fixed lateral wall 19 perpendicular to wall 17 and located in front of wall 17 in direction A; and a lateral wall 20 located behind wall 17 in direction A, and which is hinged to respective head 10 and rotated by an actuating device 21, with respect to walls 17 and 19 and about an axis 22 parallel to axis 8, to and from a closed position in which lateral wall 20 is parallel to lateral wall 19. As shown more clearly later on, lateral wall 20 defines a folding member for folding longitudinal tab 7 located, on wrapping wheel 2, between tab 6 and axis 8.

Each group 4 is fed to wheel 2 in known manner at input station 3 so as to be positioned, inside respective seat 16, with its longitudinal axis parallel to axis 8 and, as stated, with sheet 5 folded into a U about group 4 to define an inner major wall contacting bottom wall 17, with a minor lateral wall contacting lateral wall 19, and with longitudinal tabs 6 and 7 facing lateral wall 20, which, at input station 3, is in an open position tilted with respect to lateral wall 19. Once inserted inside respective seat 16, each group 4 is maintained contacting bottom wall 17 of seat 16 by a cylindrical plate 23, which is coaxial with axis 8, is located outside drum 9, and defines, with drum 9, a channel 24 for feeding groups 4 and respective sheets 5 between input station 3 and an output station 25, and through a folding station 26.

Along channel 24, each group 4 is fed through folding station 26, where tab 6, sliding along plate 23, is folded squarely onto group 4 by a folding member 27 carried by a folding device 28, which forms part of folding unit 1, is located outwards of plate 23, and penetrates channel 24 through an opening 29 formed through plate 23.

As shown more clearly in FIGS. 2 to 6, folding device 28 comprises a gear 30 fitted to a central shaft (not shown) having an axis 31 parallel to axis 8, and extending in rotary manner through a bottom wall 32 of an elongated arm or casing 33, which has a longitudinal axis 34 perpendicular to axis 31, houses gear 30, and is rotated by a motor M2 about axis 31 at a constant angular speed and in a direction C opposite direction A. Casing 33 defines the movable carrier of an epicyclic gear train 35, which, besides gear 30 defining the fixed sun gear of the train, also comprises two toothed rotors or planet wheels 36*a* and 36*b* fitted idly to wall 32 along longitudinal axis 34 to rotate, with respect to casing 33, about respective axes 37*a* and 37*b* parallel to axis 31; and two transmission gears 38*a* and 38*b* located along longitudinal axis 34; gear 38*a* meshing on opposite sides with gear 30 and planet wheel 36*a*; and gear 38*b* meshing on opposite sides with gear 30 and planet wheel 36*b*.

Each planet wheel 36 carries a number of folding members 27 equally spaced about the periphery of planet wheel 36, and each defined by a flat blade integral with and extending radially with respect to planet wheel 36.

Together with respective folding members 27, each planet wheel 36 defines a respective folding head 39 supporting n/2 number of folding members 27, where n, as stated, is the number of conveying heads 10 on drum 9. In example embodiments not shown, as opposed to having two folding heads 39, folding device 28 may comprise, in general, k number of folding heads 39 (where 1 is less than or equal to k, and k less than or equal to n) equally spaced about axis 31, and each having n/k number of respective folding members 27.

Assigning each folding member 27 a given length L as a function of the length of tab 6 to be folded, and each planet wheel 36 a radius R determined by practice, folding device 28 is activated to conform with the following system of equations:

$$W2=W1\ n/k \quad 1)$$

$$W3=W1-W2 \quad 2)$$

$$W1\ D1=W2\ (S+R+L)-W3\ (R+L) \quad 3)$$

where:

W1 is the angular speed of drum 9;

W2 is the angular speed of casing 33;

W3 is the angular speed of planet wheel 36 with respect to casing 33;

S is the distance between axes 31 and 37; and

D1 is the inside radius of plate 23.

Given the laws of motion defined by equations 1), 2) and 3), and by adjusting the timing of casing 33 and planet wheels 36 beforehand, it is possible to achieve the following:

a) each folding member 27 always cooperates with the same head 10;

b) each folding member 27 is maintained parallel to the radius of drum 9 through axis 11 of the respective head 10 at all times, or at least during the relative folding operation;

c) each head 10 and respective folding member 27 engage folding station 26 successively, at the same speed, and with folding member 27 positioned just behind respective head 10;

d) at folding station 26, the speed of each folding member 27, with respect to respective head 10, is substantially purely radial, i.e. substantially directed towards axis 8.

Consequently, as casing 33 and respective planet wheel 36 rotate to bring a folding member 27 (hereinafter referred to as 27*a* and located on planet wheel 36*a*) into folding station 26 (FIGS. 3 and 4) and in a position just behind respective head 10—hereinafter referred to as 10*a*—folding member 27*a* begins penetrating opening 29 and moves substantially in direction B to engage respective tab 6 at a relatively short distance H from a rear lateral edge of respective group 4, and then moves further inwards of channel 24 (FIG. 5), still in direction B, into a final position aligned with longitudinal axis 34, so as to fold tab 6 squarely onto group 4. In this connection, it should be stressed that folding member 27*a* slides frictionally along respective tab 6 to pull and force tab 6 to fold correctly about a rear lateral edge 40 of respective group 4.

As folding member 27*a* penetrates channel 24, head 10*a* is simultaneously swung backwards about respective axis 11 to gradually reduce distance H, so that, by the time the longitudinal axis 34 of casing 33 is aligned in direction B in said final aligned position of folding member 27*a*, folding member 27*a* is positioned contacting the rear lateral surface of respective group 4 with respective tab 6 folded completely and squarely in between. At this point, lateral wall 20, formerly in the open position, is closed to fold respective tab 7 onto respective tab 6 and so form a tubular wrapping 41 about respective group 4 and secure respective tab 6 in position. As lateral wall 20 is moved into position, folding member 27*a* is gradually withdrawn from channel 24 in direction B, and head 10*a* is rotated about respective axis 11 back into the original position.

Given the laws of motion referred to previously, as drum 9 rotates about axis 8 to feed the next head 10*b* (FIG. 6) through folding station 26, casing 33 and planet wheels 36 rotate to feed a folding member 27*b* of planet wheel 36*b* through folding station 26 in the same way as described for folding member 27*a*.

In connection with the above, it should be pointed out that the structure of folding device 28 is extremely straightforward and reliable, by folding members 27 being integral with respective planet wheels 36 and subjected to centrifugal as opposed to angular acceleration, and by each folding member 27 only having to be adjusted with respect to one head 10.

What is claimed is:

1. A method of forming tubular wrappings on a cigarette packing machine; each tubular wrapping (41) being formed from a sheet (5) of wrapping material folded into a U about a respective group (4) of cigarettes and having two end portions defining a first (6) and a second (7) tab; the method comprising the steps of feeding each group (4) continuously, by means of a respective substantially radial conveying head (10), in a direction (A) along an annular path (P) extending about a first axis (8), said second tab (7) being interposed between said first tab (6) and said first axis (8), said two end portions projecting rearwards with respect to said group (4) and to said direction (A); and folding the two tabs (6, 7) of each said sheet (5) of wrapping material onto the respective said group (4), as the group (4) is fed along said annular path (P), to form a tubular wrapping (41) about the respective said group (4); each said first tab (6) being folded by means of a respective outer folding member (27), which is associated with the respective said conveying head (10), is located outwards of said annular path (P), and is movable to cooperate with the respective said first tab (6) at a folding station (26); said outer folding members (27) being equal in number to said conveying heads (10) located along said annular path (P); and each said outer folding member (27) being moved continuously and in such a manner as to remain substantially parallel at all times to the respective said conveying head (10).

2. A method as claimed in claim 1, characterized in that each said outer folding member (27) is advanced in such a manner as to travel through said folding station (26) at a speed substantially equal to a traveling speed of the respective conveying head (10), and to perform, with respect to the respective said conveying head (10), a radial movement towards and away from said first axis (8).

3. A method as claimed in claim 1, characterized in that each said outer folding member (27) is maintained substantially parallel at all times to the respective said conveying head (10) by imparting to the outer folding member (27) a movement derived from the combination of a first movement obtained by rotating the outer folding member (27) continuously about a respective second axis (37), and a second movement obtained by rotating said second axis (37) continuously about a third axis (31) located a given distance (S) from said second axis (37); said second axis (37) and said third axis (31) being parallel to said first axis (8).

4. A method as claimed in claim 3, characterized in that said outer folding members (27) are arranged about at least two said second axes (37*a*, 37*b*) equally spaced about said third axis (31).

5. A method as claimed in claim 3, characterized in that the movement of each conveying head (10) about said first axis (8), and the movement of the respective outer folding member (27) are governed by the following laws of motion:

$$W2=W1\ n/k \quad 1)$$

$$W3=W1-W2 \quad 2)$$

$$W1\ D1=W2(S+R+L)-W3(R+L) \quad 3)$$

where:

W1 is the angular traveling speed of the conveying heads (10) about said first axis (8);

W2 is the angular speed of said second movement;

W3 is the angular speed of said first movement;

S is said distance between said second axis (37) and said third axis (31);

D1 is a distance between said first tab (6) and said first axis (8);

(R+L) is a distance between a free end of said outer folding member (27) and the respective said second axis (37);

n is the number of conveying heads (10) distributed along said annular path (P); and k is the number of second axes (37) present.

6. A method as claimed in claim 3, characterized in that said first movement and said second movement of each said outer folding member (27) are timed with respect to the movement of the respective said conveying head (10) about said first axis (8), so that the outer folding member (27) travels through at least an input portion of said folding station (26) in a position behind said conveying head (10) and at a distance (H), from the respective said group (4), other than zero but less than a length of the respective said first tab (6), and gradually reaches, inside the folding station (26), a final position in which the outer folding member (27) is located outside a space extending between said second axis (37) and said third axis (31), and is aligned with said second axis (37) and said third axis (31).

7. A method as claimed in claim 6, characterized in that each said conveying head (10) is fitted to a conveying drum (9) coaxial with said first axis (8), so as to oscillate, with respect to the conveying drum (9), about a fourth axis (11) parallel to said first axis (8); the method comprising the further step of imparting to each said conveying head (10), inside said folding station (26), a reverse oscillation about said fourth axis (11) so as to bring the respective said group (4) into contact with the- respective said outer folding member (27) in said final position.

8. A method as claimed in claim 1, characterized in that each said second tab (7) is folded onto the respective said group (4) after the respective said first tab (6) is folded, and by means of a respective inner folding member (20) carried by the respective said conveying head (10) and movable, with respect to the conveying head (10), to and from a closed position contacting the respective said group (4).

* * * * *

UNITED STATES PATENT AND TRADEMARK OFFICE

CERTIFICATE OF CORRECTION

PATENT NO. : 6,513,533 B2
DATED : February 4, 2003
INVENTOR(S) : Spatafora et al.

It is certified that error appears in the above-identified patent and that said Letters Patent is hereby corrected as shown below:

Column 5,
Line 42, please delete “in such a manner as”.

Column 6,
Line 51, please delete “with the- respective” and insert -- with the respective --.

Signed and Sealed this

Seventh Day of October, 2003

JAMES E. ROGAN
*Director of the United States Patent and Trademark Office*